US008366025B2

(12) United States Patent
Cheng et al.

(10) Patent No.: US 8,366,025 B2
(45) Date of Patent: Feb. 5, 2013

(54) SHOWER HEAD

(75) Inventors: Mengfeng Cheng, Taichung (TW); Shengping Hu, Shen Zen (CN); Dajun Zhang, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 111 days.

(21) Appl. No.: 13/088,225

(22) Filed: Apr. 15, 2011

(65) Prior Publication Data

US 2012/0261488 A1 Oct. 18, 2012

(51) Int. Cl.
*B05B 17/08* (2006.01)

(52) U.S. Cl. ..... 239/447; 239/443; 239/548; 239/552; 239/556; 239/562; 239/569; 239/578; 239/581.1

(58) Field of Classification Search ..... 239/443, 239/445–449, 548, 552, 556, 562, 569, 578, 239/581.1, 583; 4/605, 620, 900
See application file for complete search history.

(56) References Cited

U.S. PATENT DOCUMENTS

| | | | | |
|---|---|---|---|---|
| 2,949,240 | A * | 8/1960 | Koolnis | 239/581.1 |
| 4,273,289 | A * | 6/1981 | Jette | 239/578 |
| 4,398,668 | A * | 8/1983 | Jette | 239/581.1 |
| 4,651,930 | A * | 3/1987 | Magaha, Jr. | 239/578 |
| 5,768,721 | A * | 6/1998 | Kersten | 4/900 |
| 6,474,621 | B1 * | 11/2002 | Vogel | 239/578 |
| 8,113,446 | B2 * | 2/2012 | Kline et al. | 4/900 |

* cited by examiner

*Primary Examiner* — Steven J Ganey

(57) ABSTRACT

A shower head contains a body including an inflow passage, a plurality of distributing passages, and a first groove; a rotary disk including a second disc portion, a post portion extending, an opening; a first resilient element used to provide a driving force and a restoring force onto the rotary disk; a pushing member fixed in the rotary disk and including a number of second ratchet blocks; a second resilient element used to provide the restoring force onto the pushing member after releasing the pulling force; a pulling device served to provide the pulling force on the pushing member and including an external portion extending from the body to be forced and an internal portion located at the body to be pulled, the internal portion at least containing a pull line member with a suitable length to insert through the inflow passage of the body.

12 Claims, 14 Drawing Sheets

SHOWER HEAD

BACKGROUND OF THE INVENTION

1. Field of the Invention

The present invention relates to a shower head that is fixed on a wall and is capable of being adjusted its angle to spray water splashes.

2. Description of the Prior Art

A conventional shower head is fixed on a wall and capable of being lifted a flowing path by rotating a cover, but it is force-consuming to operate the shower head due to the cover is fixed at a higher position. Another conventional shower head disclosed in CN Pub. No. 201143473Y is capable of being lifted its flowing path by using a pull line, however its structure is quite complicated, thereby operating the shower head inconveniently.

A structure of conventional shower head to lift a flowing path disclosed in the CN Pub. No. 101862711A is capable of being rotated to lift the flowing path, but it still has the following defects:

1. The pull line is applied to actuate a ratchet shaft to rotate, however a forcing angle and direction of the pull line will be close to a horizontal angle to make the pull line be at a higher forcing point without being operated easily by the older and children.

2. A dead angle of the pulling force will generate, so a pulling block will not actuate the ratchet shaft to rotate smoothly. Even though the ratchet shaft is actuated to rotate, the pull line will support a larger pull force to decrease its service life. In addition, only small part of the pull force is used to rotate the pulling block and the ratchet shaft, and most part thereof will act on an abnormal operating direction and angle of the pulling block and the ratchet shaft to break the structure among the pulling block, the ratchet shaft, and the related components, thus further breaking or losing the lifting function of the flowing path.

3. Such a conventional shower head can not be equipped with a knob member because when adjusting a certain angle of the knob member, the forced direction of the pull line is changed greatly to cause a dead angle without operating the shower head smoothly.

The present invention has arisen to mitigate and/or obviate the afore-described disadvantages.

SUMMARY OF THE INVENTION

The primary object of the present invention is to provide a shower head which is capable of overcoming the shortcomings of the conventional shower head.

Further object of the present invention is to provide a shower head that the pulling force is provided on the pushing member in the axial direction without generating a dead angle during operation, thus operating the shower head effortlessly and smoothly. Furthermore, the second pull line falling vertically is applied to be operated easily by the old and children.

Another object of the present invention is to provide a shower head of which the first and the second pull lines are served to provide the pulling force so that when the head assembly rotates on the tube member, various spray angles of the water splash can be adjusted without stopping lifting the water splash level To obtain the above objectives, a shower head provided by the present invention contains:

a body including an inflow passage, a plurality of distributing passages extending from the inflow passage to distribute the water so as to generate multi-level water splash, and a first groove communicating with the inflow passage; the first groove including a ratchet seat, the ratchet seat including a plurality of ratchet blocks fixed thereon, and between any two adjacent first ratchet blocks is defined a second groove;

a rotary disk installed in the inflow passage of the body and including a second disc portion, a post portion extending downward from the second disc portion, an opening passing through the second disc portion and the post portion; the second disc portion including at least one third bore to alternatively communicate with the distributing passages with rotation; the post portion including at least one annular ratchet integrally formed on a bottom end thereof to engage with the ratchet seat, such that the ratchet is acted by an axial pushing force, a peripheral driving force, and an axial restoring force in order to rotate a predetermined angle on the ratchet seat so that the third bore of the second disc portion is rotated to communicate with another distributing passage;

a first resilient element used to provide a driving force and the restoring force onto the rotary disk;

a pushing member fixed in the opening of the rotary disk and including a number of second ratchet blocks to be retained in the second grooves of the ratchet seat of the body so as to be limited to move vertically; the second ratchet blocks moves upward when the pushing member is pulled by an axial pulling force to move upward, teeth of the rotary disk are pushed by the pushing member to disengage from the first ratchet blocks, and the rotary disk is released by the pulling force to move back to an original position;

a second resilient element used to provide the restoring force onto the pushing member after releasing the pulling force;

a pulling device served to provide the pulling force on the pushing member and including an external portion extending from the body to be forced and an internal portion located at the body to be pulled, the internal portion at least containing a pull line member with a suitable length to insert through the inflow passage of the body

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
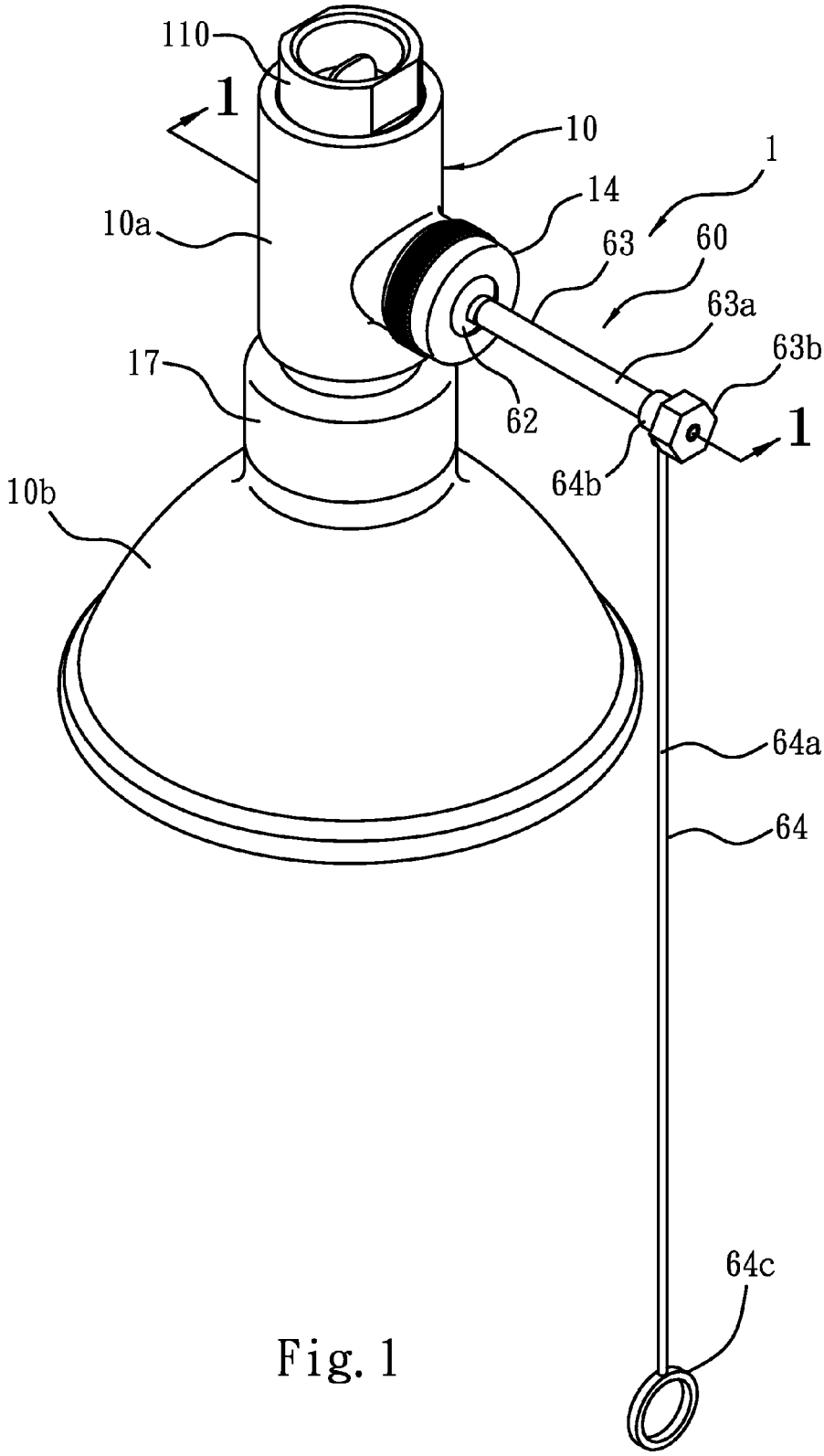
FIG. 1 is a perspective view showing the assembly of a shower head according to a first embodiment of the present invention.
Figure 2:
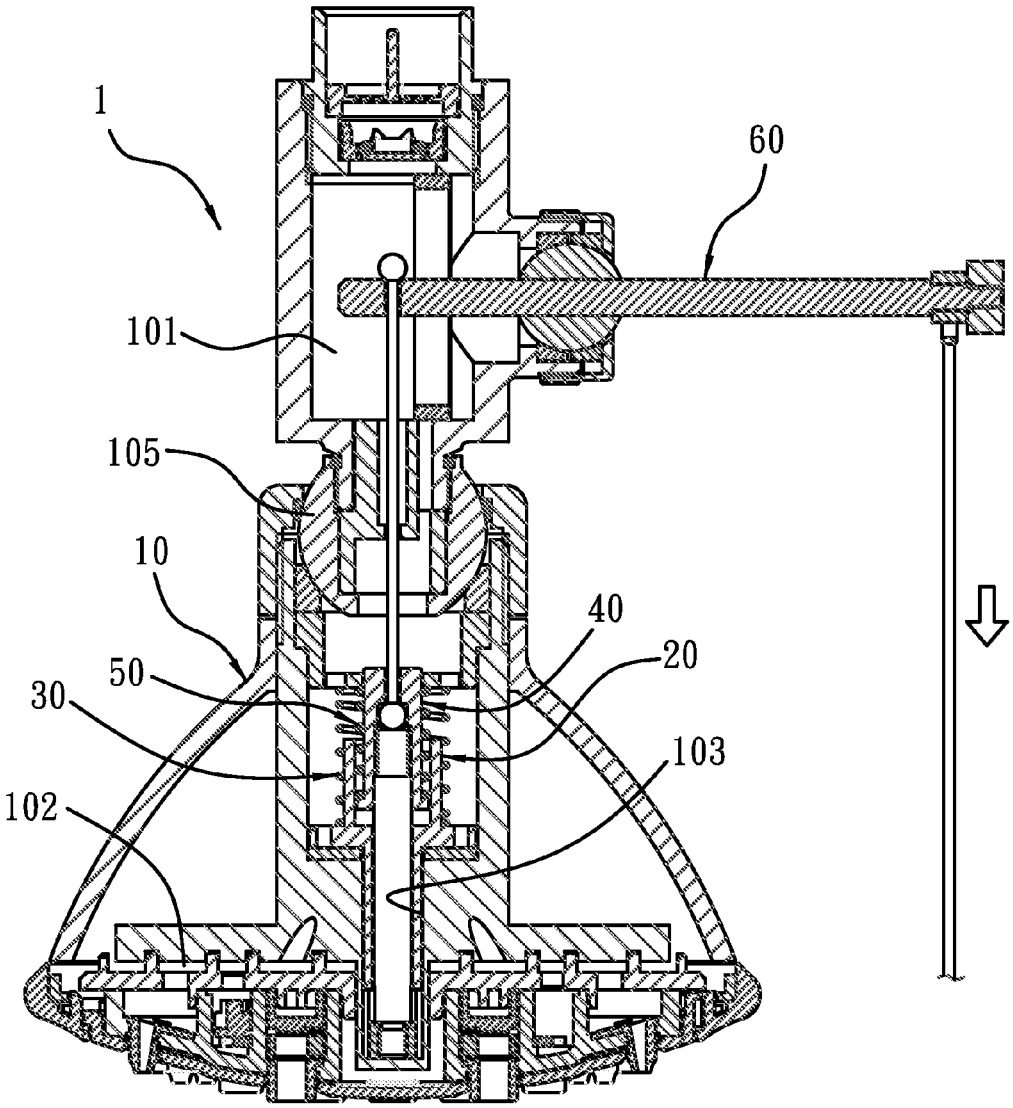
FIG. 2 is a cross sectional view taken along the lines 1-1 of FIG. 1 and showing the operation of the second pull line.
Figure 3:
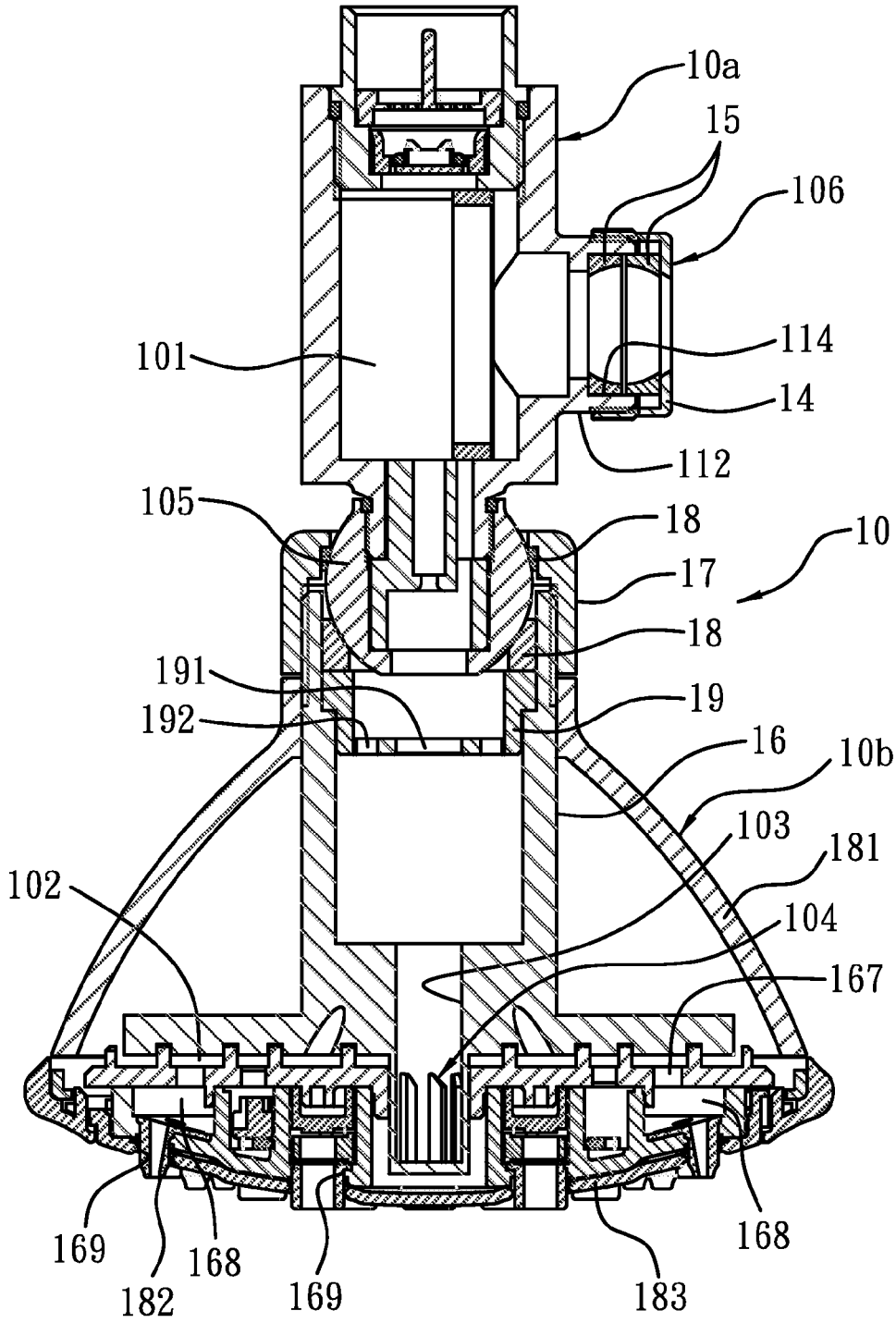
FIG. 3 is a cross sectional view showing the assembly of a body of the shower head according to the first embodiment of the present invention.

Referring to FIGS. 1-3, a shower head 1 according to a first embodiment of the present invention is fixed on a wall and is capable of being adjusted its angle to spray water splashes. The shower head 1 includes a body 10, a rotary disk 20, a first resilient element 30, a pushing member 40, a second resilient element 50, and a pulling device 60.

The body 10 includes an inflow passage 101, a plurality of distributing passages 102 extending from the inflow passage 101 to distribute the water so as to generate multi-level water splash, and a first groove 103 communicating with the inflow passage 101; the first groove 103 includes a ratchet seat 104.

Figure 4:
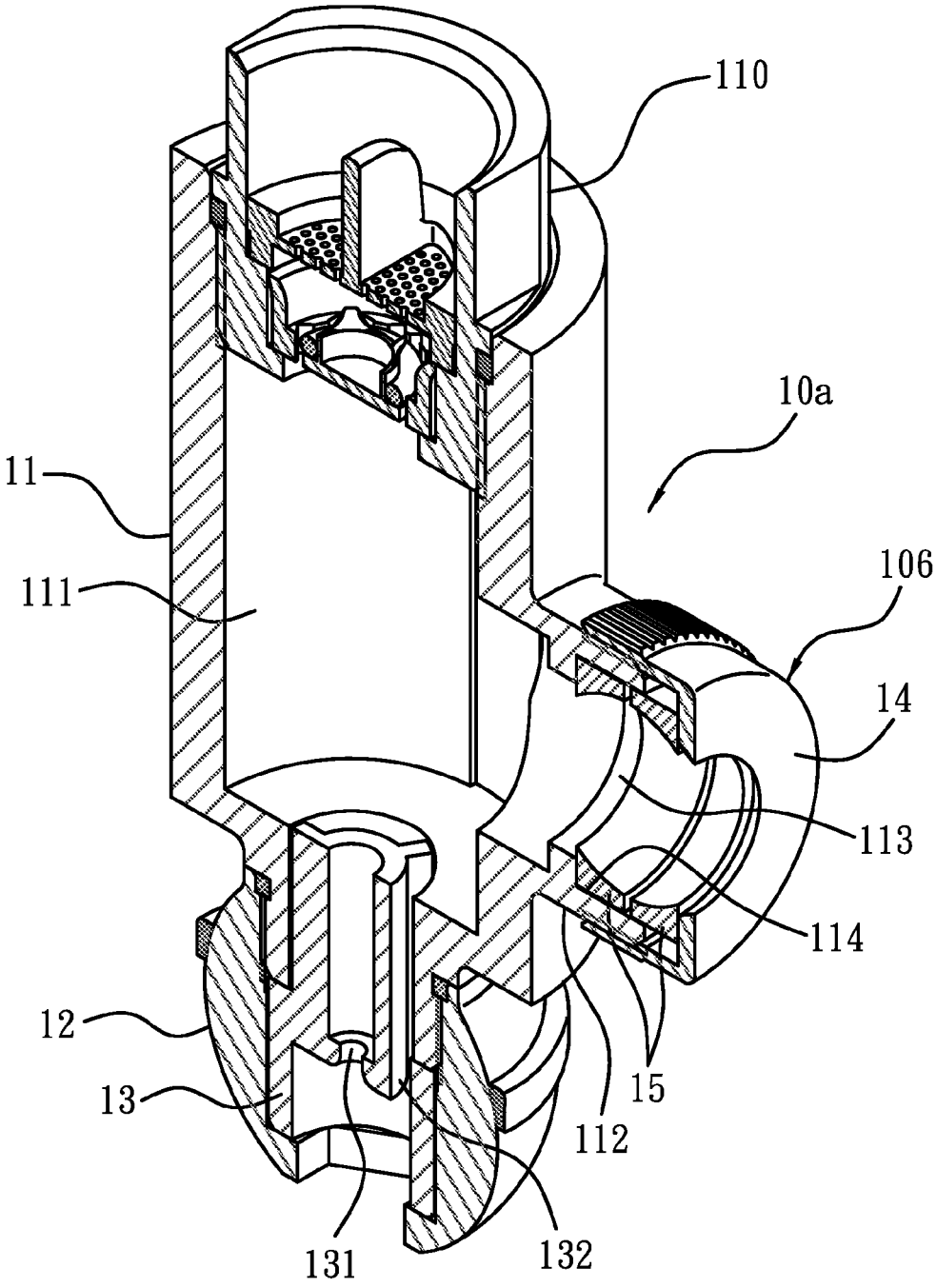
FIG. 4 is a cross-sectional perspective view showing the assembly of a tube member of the shower head according to the first embodiment of the present invention.
Figure 5:
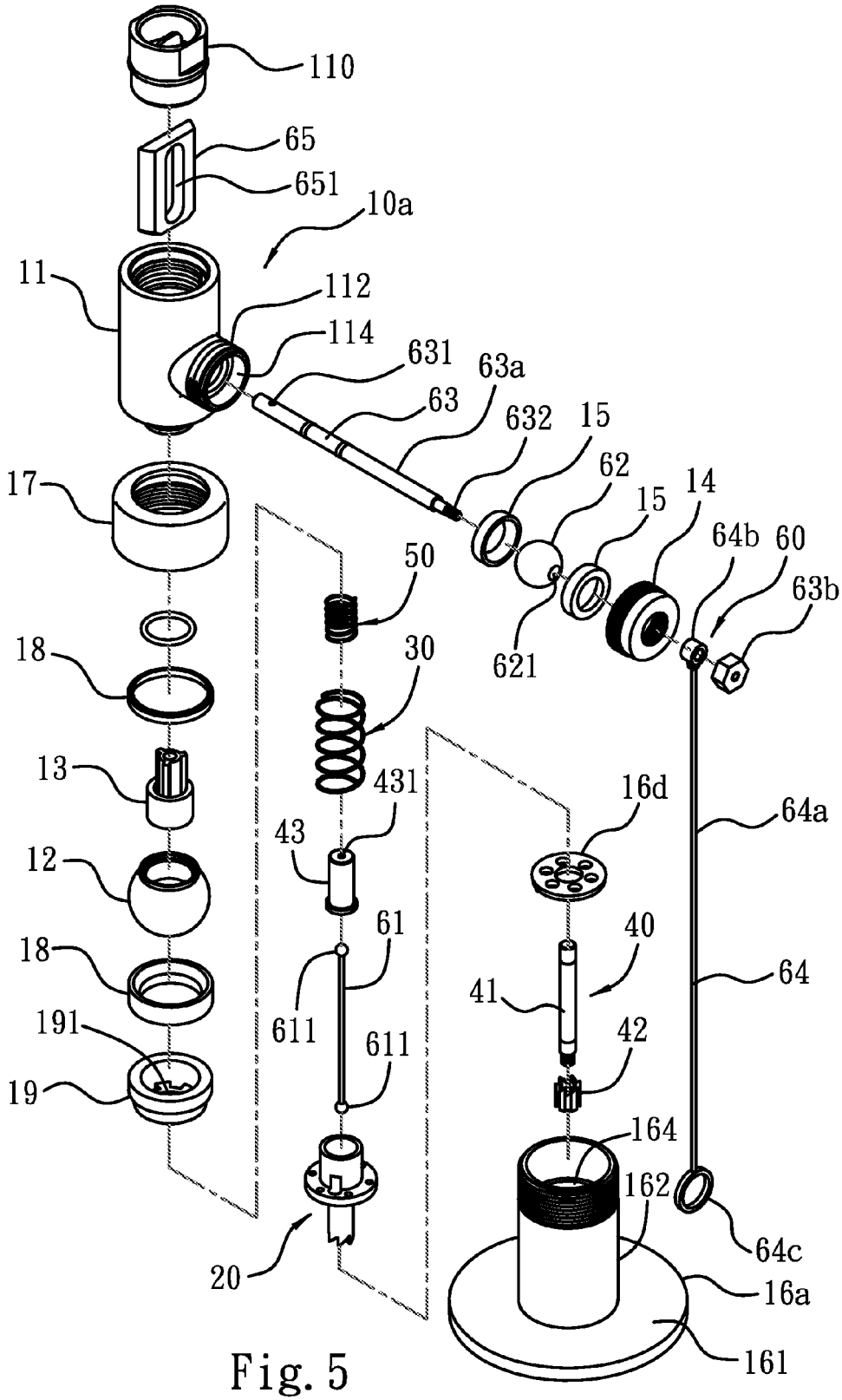
FIG. 5 is a perspective view showing the exploded components of the shower head acceding to the first embodiment of the present invention.

The body 10 includes a tube member 10*a* to flow the water inward and a head assembly 10*b* as shown in FIG. 3, wherein the tube member 10*a* as illustrated in FIGS. 4 and 5 is used to form an upper flowing portion of the inflow passage 101 and includes a housing 11, a spherical member 12, a holder 13, a cover 14, and two washers 15.

The housing 11 includes a tunnel 111 formed therein to define one part of the inflow passage 101, an inlet segment to form the shower head 1 secured on a top end thereof, and a projection 112 extending from an outer surface of a peripheral wall thereof, and the projection 112 includes a through hole 113 communicating with the tunnel 111 and a positioning slot 114 proximate to the through hole 113. The housing 11 also includes a joint 110 screwed on a top end thereof to connect with an inlet pipe and to receive a throttle valve and a filter.

The spherical member 12 is screwed with a bottom end of the housing 11 so that a spherical knob 105 is formed on a bottom end of the tube member 10*a* as shown in FIGS. 2 and 3.

Figure 6:
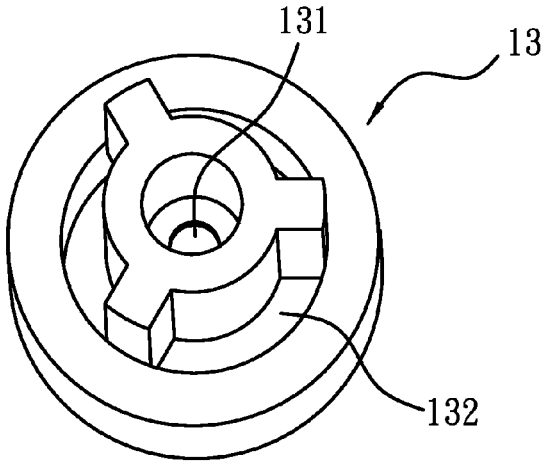
FIG. 6 is a perspective view showing assembly of a holder of the shower head acceding to the first embodiment of the present invention.

The holder 13 is defined between the spherical member 12 and the housing 11 as illustrated in FIG. 6 and includes a first bore 131 with a number of first tiny orifices 132.

The cover 14 is locked on the projection 112 of the housing 11.

The washer 15 is forced by the cover 14 to be further retained in the positioning slot 114 of the projection 112.

The housing 11 is used to form a spherical mount 106 as illustrated in FIG. 3 by using the positioning slot 114 of the projection 112, the cover 14, and the washer 15.

Figure 7:
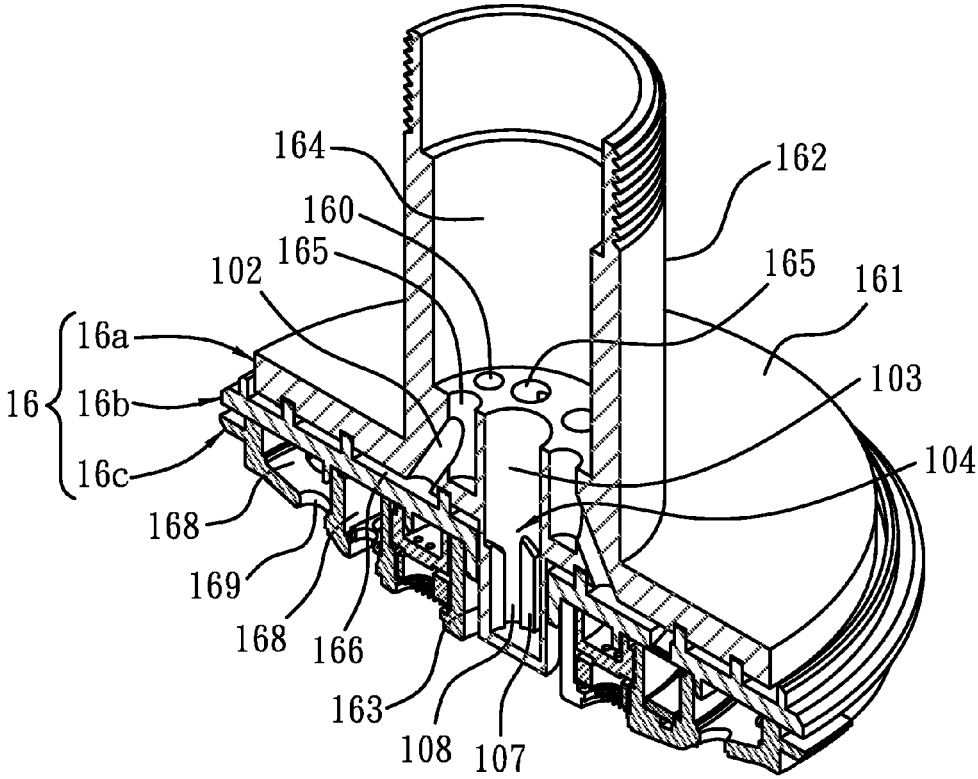
FIG. 7 is a cross-sectional perspective view showing assembly of the passage assembly of the shower head acceding to the first embodiment of the present invention.
Figure 8:
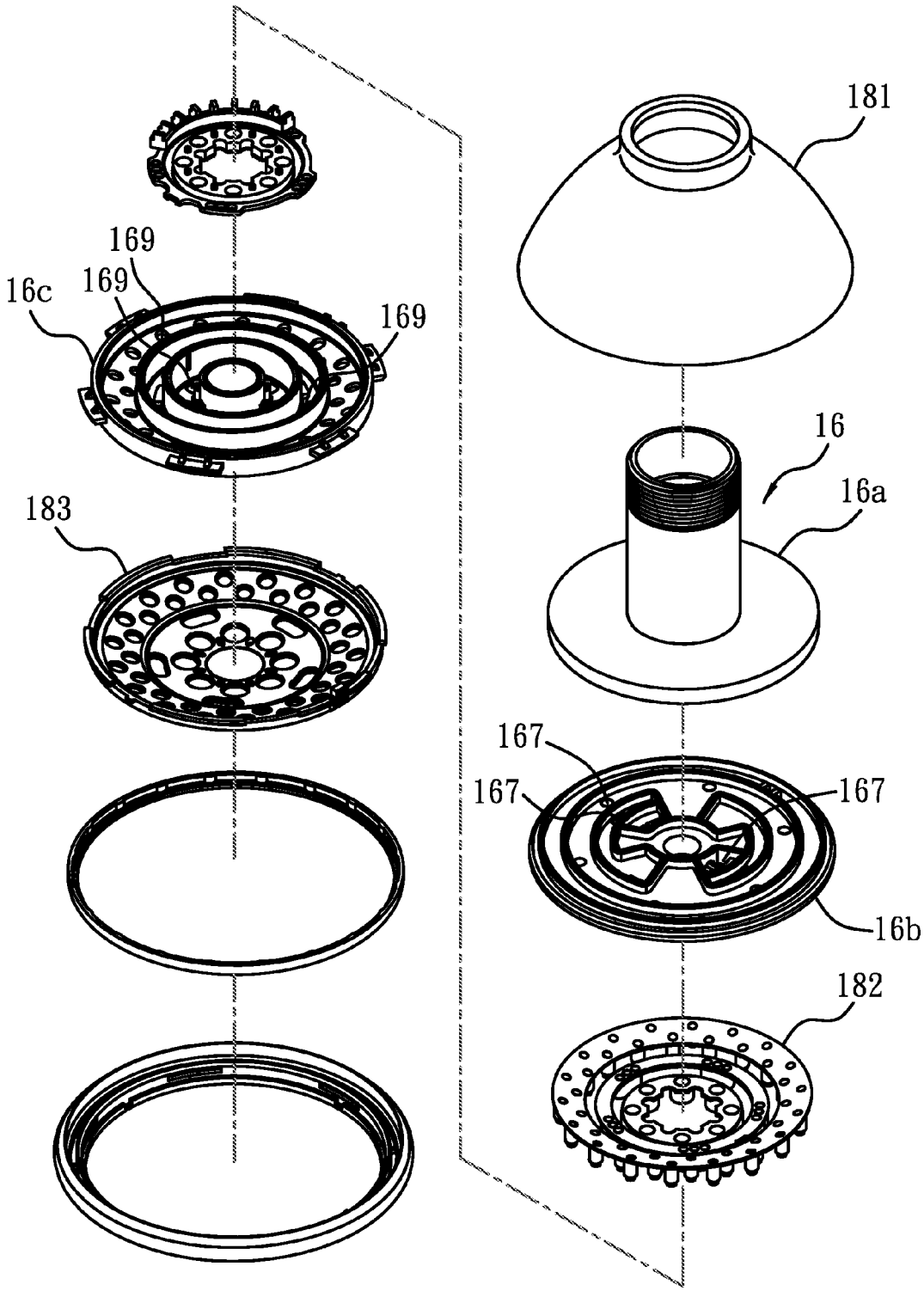
FIG. 8 is a perspective view showing the assembly of a head assembly of the passage assembly of the shower head acceding to the first embodiment of the present invention.

The head assembly 10*b* as shown in FIGS. 3, 7, and 8 includes a passage assembly 16, a screwing element 17, two pads 18, a stopping member 19, a casing 181, a nozzle member 182, and a lid 183.

The passage assembly 16 is provided to form one parts of the inflow passage 101 and the distributing passages 102 and includes a first circular plate 16*a*, a second circular plate 16*b*, and a third circular plate 16*c*.

Figure 9:
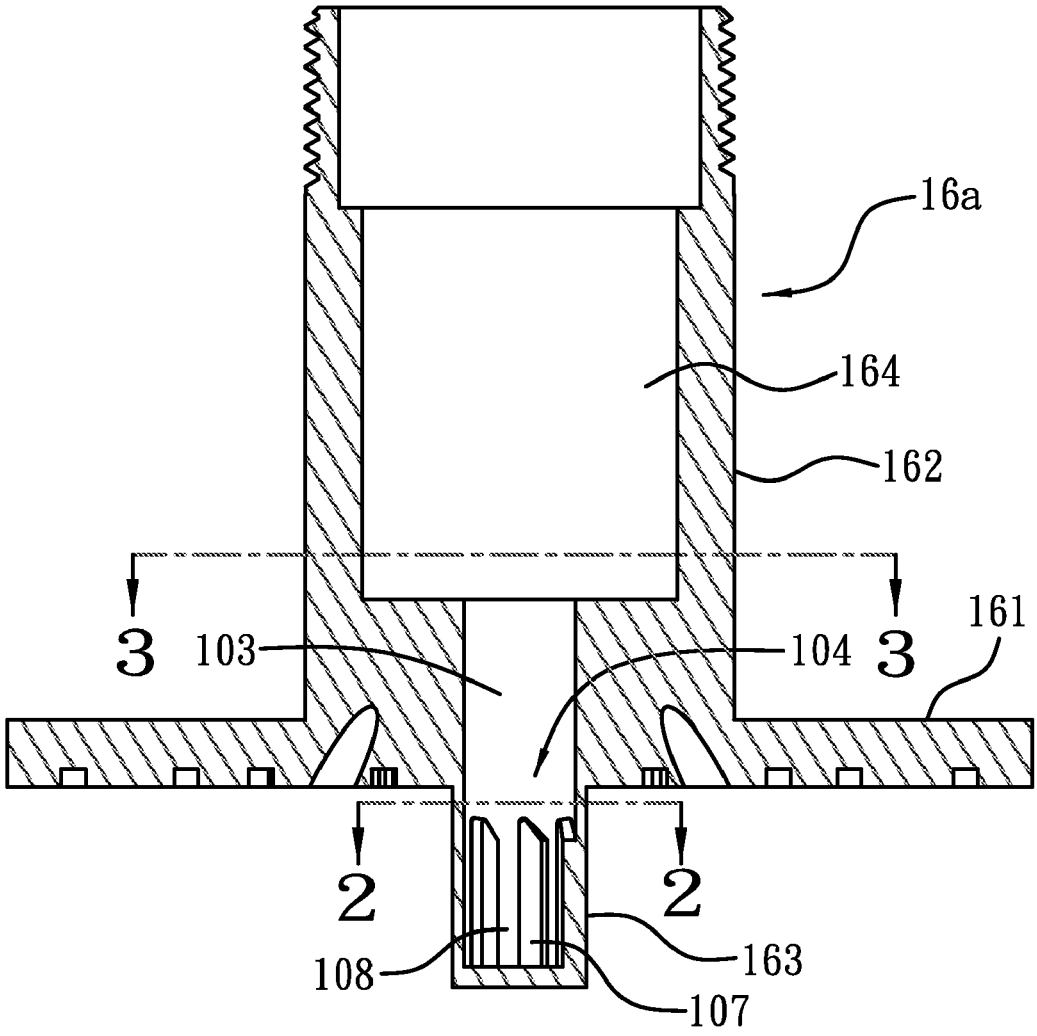
FIG. 9 is a cross sectional view showing the assembly of a first circular plate of the shower head acceding to the first embodiment of the present invention.

The first circular plate 16*a* includes a first disc portion 161, an upper shaft portion 162 extending upward from a top surface of the first disc portion 161, a lower shaft portion 163 extending downward from a bottom surface of the first disc portion 161 as illustrated in FIG. 9; the upper shaft portion 162 includes a cavity 164 disposed on a top end thereof to form a lower flowing portion of the inflow passage 101, and the cavity 164 includes the first groove 103 fixed on a central position of a bottom surface thereof, the first groove 103 extends toward the lower shaft portion 163 and includes the ratchet seat 104 formed therein.

In this embodiment, the ratchet seat 104 includes six first ratchet blocks 107 fixed in an equiangular arrangement manner, and between any two adjacent first ratchet blocks 107 is defined a second groove 108.

Figure 11:
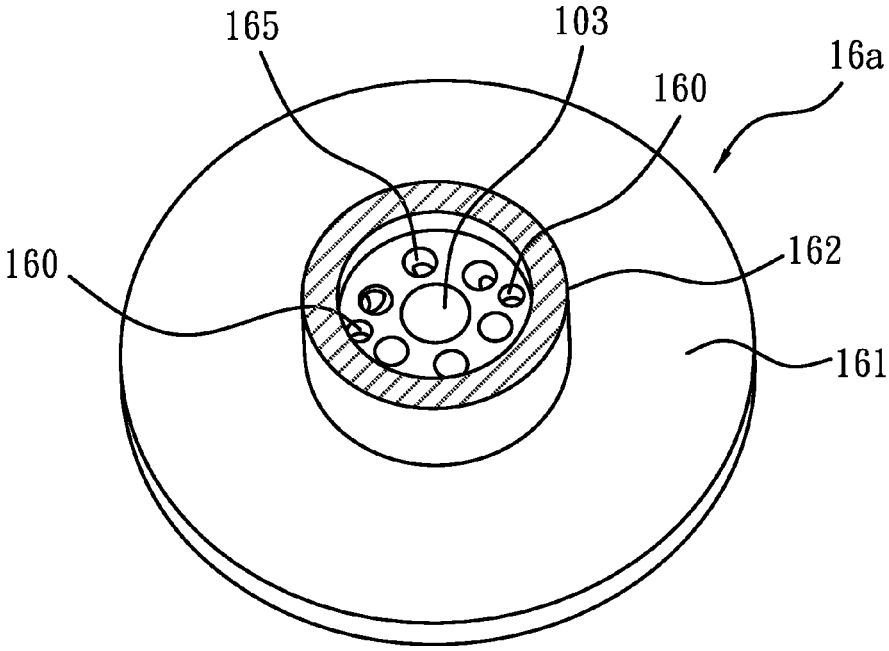
FIG. 11 is a cross sectional view taken along the lines 3-3 of FIG. 9.

In this embodiment, the cavity 164 of the first circular plate 16*a* includes six inlets 165 formed on the bottom surface thereof in an equiangular arrangement manner as shown in FIG. 11, and any two opposite inlets 165 are used as one inlet set 165, therefore there are three inlet sets 165 in this embodiment.

Between the second circular plate 16*b* and the first circular plate 16*a* are defined three sets of first distributing rooms 166 as illustrated in FIG. 7 to communicate with the three inlet sets 165 respectively, and each set of the distributing room 166 includes at least one first aperture 167 arranged therein as shown in FIG. 8.

Between the third circular plate 16*c* and the second circular plate 16*b* are defined three second distributing rooms 168 to communicate with the first distributing rooms 166 individually, and each second distributing room 168 includes a plurality of outlets 169 to spray the water.

The passage assembly 16 is capable of forming three distributing passages 102 by ways of the three inlet sets 165, the three sets of first distributing rooms 166, and the three second distributing rooms 168. Because each set of distributing passage 102 is capable of being formed one water splash mode, there are three water splash modes provided in this embodiment. Since the structure of the distributing passage 102 is well-know, only some features are described as follows.

The screwing element 17 is screwed with the top end of the upper shaft portion 162 of the first circular plate 16*a*.

The pads 18 are fixed on a top end of the cavity 164 of the first circular plate 16*a* and limited by the screwing element 17 so that the spherical knob 105 is limited by the pads 18, such that the first circular plate 16*a* allows to rotate on the spherical knob 105, thereby adjusting a spray angle of the water splash.

Figure 12:
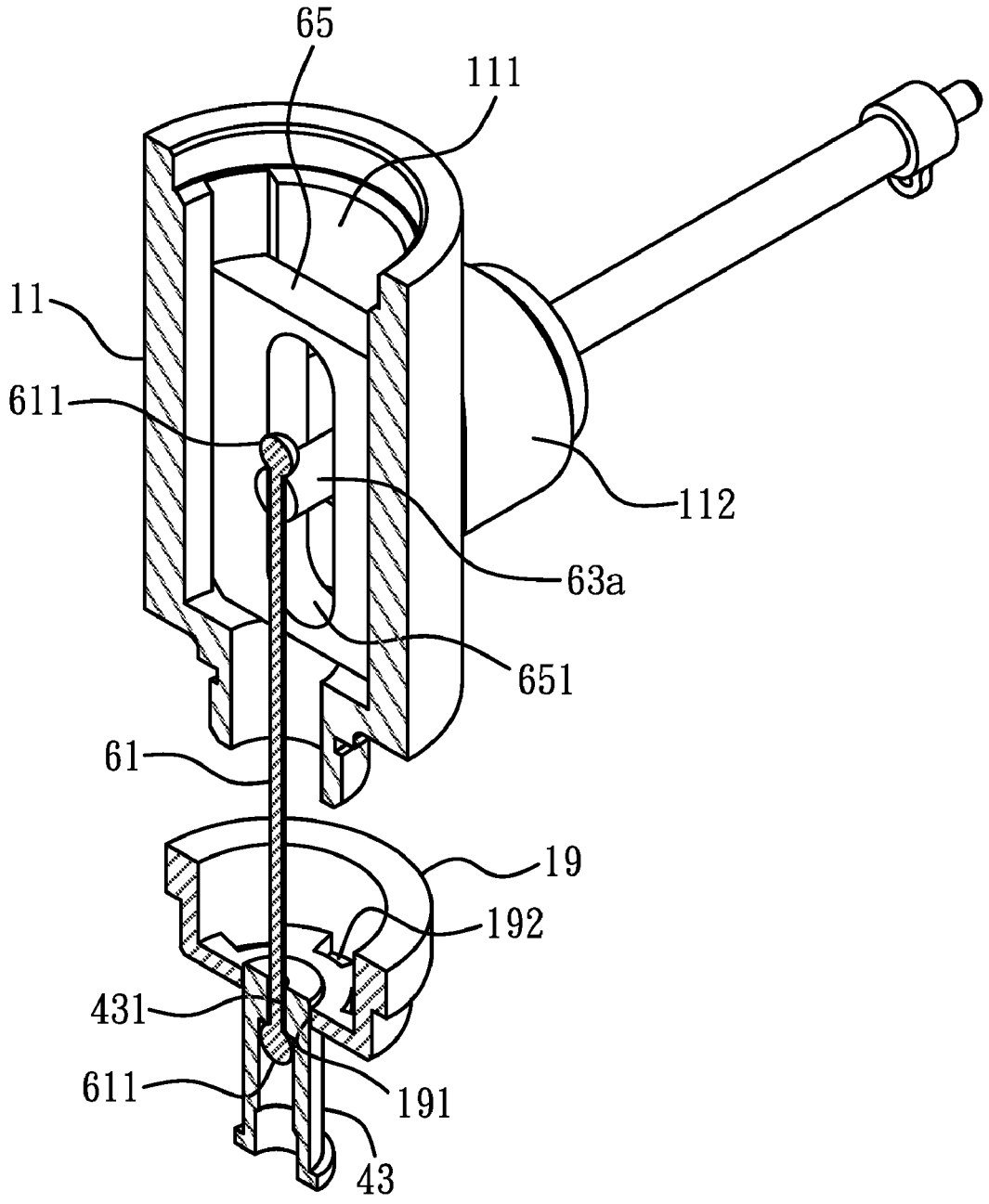
FIG. 12 is a cross-sectional perspective view showing a partial assembly of the shower head according to the first embodiment of the present invention.

The stopping member 19 as shown in FIGS. 3 and 12 is limited on the top end of the cavity 164 of the first circular plate 16*a* and defined between the pads 18 and includes a second bore 191 secured on a central position thereof, and the second bore 191 includes a number of second tiny orifices 192 formed around a peripheral surface thereof.

The casing 181 as illustrated in FIG. 3 is fitted on a top end of the upper shaft portion 162 of the first circular plate 16*a* and is fixed by the screwing element 17.

The nozzle member 182 as shown in FIGS. 3 and 8 is defined between the third circular plate 16*c* and the second circular plate 16*b* and includes a plurality of nozzles communicating with the outlets 169 via the third circular plate 16*c* so that the water flows into the second distributing rooms 168 and then sprays outward in a predetermined water splash mode.

The lid 183 as illustrated in FIGS. 3 and 8 is fixed on the third circular plate 16*c*.

Figure 13:
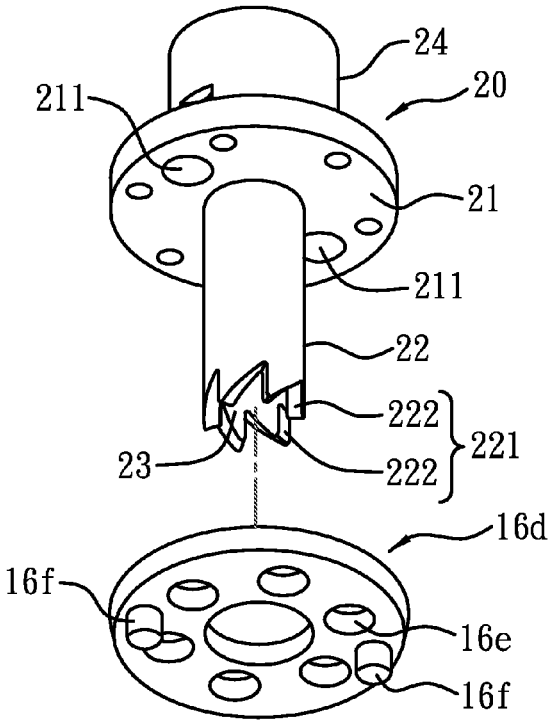
FIG. 13 is a perspective view showing the assembly of a rotary disk and a sealing ring of the shower head according to the first embodiment of the present invention.
Figure 14:
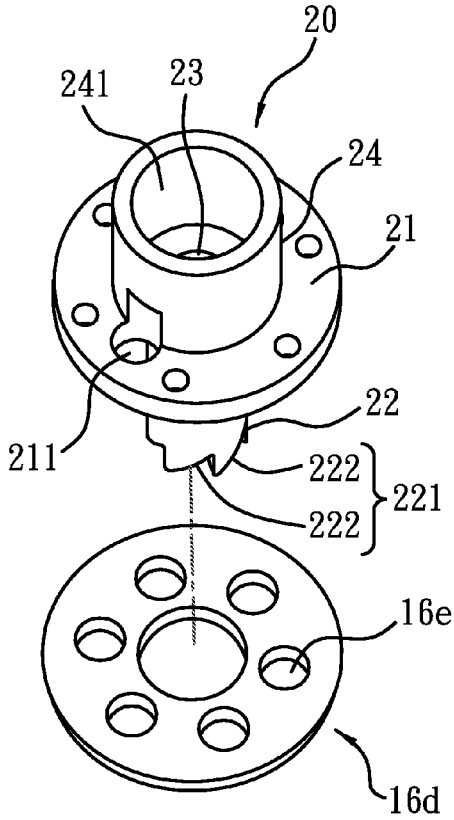
FIG. 14 is another perspective view showing the assembly of the rotary disk and the sealing ring of the shower head according to the first embodiment of the present invention.

The rotary disk 20 as shown in FIGS. 2, 13, and 14 is installed in the cavity 164 of the first circular plate 16*a* of the body 10 and includes a second disc portion 21, a post portion 22 extending downward from the second disc portion 21, an opening 23 passing through the second disc portion 21 and the post portion 22, and a first fitting portion 24 extending upward from a top end thereof.

The second disc portion 21 includes at least one third bore 211, wherein there are two opposite third bores 211 provided in this embodiment to alternatively communicate with one set of inlets 165 with rotation, accordingly the water flows into the inlet 165 and the cavity 164 via the cavity 164 of the first circular plate 16*a* to generate the water splash.

To enhance the tightness between the second disc portion 21 and the cavity 164 of the first circular plate 16*a*, a sealing ring 16*d* is fixed between the second disc portion 21 and the cavity 164 and includes six fourth bores 16*e* secured thereon in an equiangular arrangement manner and two fixing pegs 16*f* extending upward from a bottom end thereof to retain with two first recesses 160 on the bottom surface thereof as illustrated in FIG. 11.

The post portion 22 includes at least one annular ratchet 221 integrally formed on a bottom end thereof, there are six teeth 222 provided in an equiangular arrangement manner to engage with the six first ratchet blocks 107 of the ratchet seat 104, such that when the ratchet 221 is acted by an axial pushing force, a peripheral driving force, and an axial restoring force in order, it rotates 60 degrees on the ratchet seat 104 in a predetermined circumferential direction so that the third bore 211 of the second disc portion 21 is rotated to communicate with another inlet set 165 of the first circular plate 16*a*, thus lifting water splash level.

The fitting portion 24 includes a second recess 241 formed therein to communicate with the opening 23.

The first resilient element 30 as illustrated in FIG. 2 is a compression spring to be fitted onto the fitting portion 24 of the rotary disk 20 and includes two ends to abut against the rotary disk 20 and the stopping member 19 respectively so as to provide the driving force and the restoring force onto the rotary disk 20.

Figure 10:
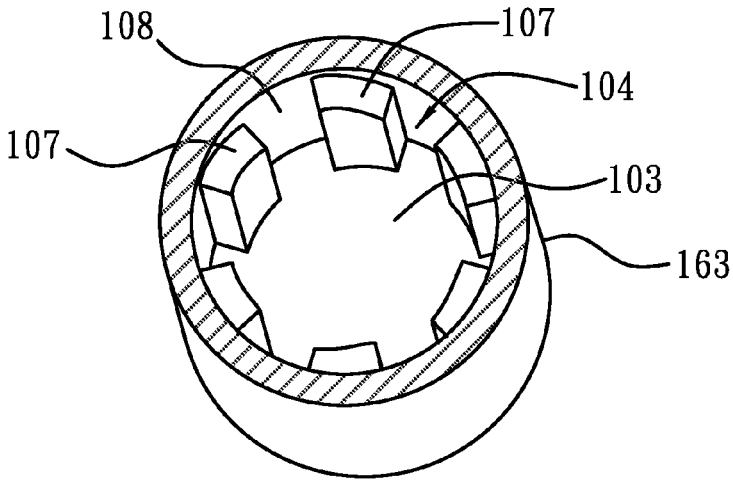
FIG. 10 is a cross sectional view taken along the lines 2-2 of FIG. 9.
Figure 15:
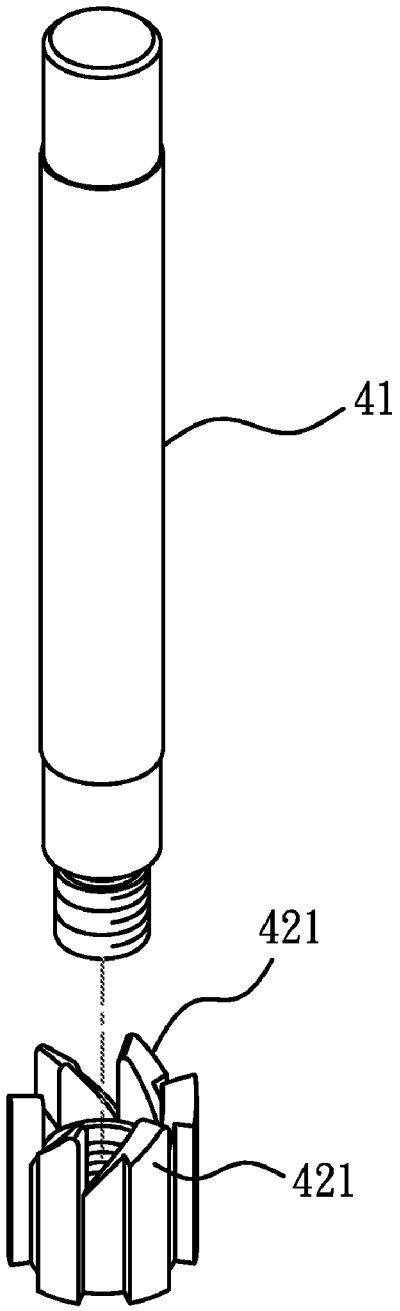
FIG. 15 is a perspective view showing a part of the assembly of a pushing member of the shower head according to the first embodiment of the present invention.

The pushing member 40 as shown in FIGS. 2, 5, 15 includes a stem 41, a first sleeve 42, and a second sleeve 43, wherein the first sleeve 42 is screwed with a bottom end of the stem 41 and includes six second ratchet blocks 421 secured in an equiangular arrangement manner to be retained in the second grooves 108 of the first circular plate 16*a* as shown in FIG. 10 so as to be limited to move vertically along the second grooves 108. The second ratchet blocks 421 match with the teeth 222 of the ratchet 221 so that when the first sleeve 42 is actuated to move upward with the stem 41, the teeth 222 of the ratchet 221 disengage from the first ratchet blocks 107 of the ratchet seat 104 of the first circular plate 16*a*, the rotary disk 20 is pushed by the first sleeve 42.

The second sleeve 43 as illustrated in FIG. 12 is fixed on a top end of the stem 41 and moves in the second bore 191 of the stopping member 19 so that the pushing member 40 is capable of moving vertically, wherein the second sleeve 43 includes a fifth bore 431 arranged on a central portion thereof.

The second resilient element 50 as illustrated in FIG. 2 is a compression spring to be fitted on the second sleeve 43 and includes two ends to abut against the pushing member 40 and the stopping member 19 individually. After a pulling force acted on the pushing member 40 is released, the second resilient element 50 pushes the pushing member 40 to move downward.

The pulling device 60 includes a first pull line 61, a spherical member 62, a shank 63, a second pull line 64, and a guiding member 65 as illustrated in FIGS. 2 and 5.

The first pull line 61 includes two tabs 611 formed on two ends thereof respectively to insert through the first bore 131 of the holder 13 and the fifth bore 431 of the second sleeve 43, and the tabs 611 are defined between the second sleeve 43 and the stem 41 to connect with a top end of the pushing member 40. In this embodiment, the first pill line 61 is a soft steel wire.

The spherical member 62 is defined between the two washers 15 of the positioning slot 114 of the housing 11 and includes a first pore 621 formed thereon.

The shank 63 includes a first extension 63*a* and a limiting nut 63*b* screwed on an outer side of the first extension 63*a;* the first extension 63*a* inserts through the first pore 621 of the spherical member 62 and includes a second pore 631 to insert the first pull line 61 so that the tabs 611 of the first pull line 61 are limited on the top side of the second pore 631 to prevent the tabs 611 from disengaging from the shank 63, such that the first pull line 61 is coupled with an inner end of the shank 63. The first extension 63*a* includes an axial second fitting portion 632 disposed on an inner side of the limiting nut 63*b*.

The second pull line 64 includes a second extension 64*a*, a ring 64*b* connected with a top end of the second extension 64*a*, and a loop 64*c* coupled with a bottom end of the second extension 64*a;* the ring 64*b* is fitted on the axial second fitting portion 632 of the shank 63 and is axially limited by the limiting nut 63*b*, such that the second pull line 64 falls vertically, and when the loop 64*c* is pulled downward, the shank 63 is actuated to rotate so that the first pull line 61 is actuated to pull the pushing member 40.

The guiding member 65 is fixed in the tunnel 111 of the housing 11 and is positioned by the joint 110 and includes a third groove 651 formed thereon to insert the shank 63 and to limit the shank 63 to slide in the third groove 651 so that the first pull line 61 is pulled in an axial direction.

It is preferable that the first pull line 61, the first bore 131 of the holder 13, the fifth bore 431 of the second sleeve 43, the pushing member 40, and the rotary disk 20 are fixed on a centrally axial segment of the tube member 10*a* and the tube member 10*a* to assemble the shower head 1 precisely and to keep the pulling force of the first pull line 61 acting axially along or close to the pushing member 40, thus obtaining a largest pulling force to operate the shower head effortlessly.

The shower head 1 is pulled downward to lift the water splash level. In operation, the loop 64*c* of the second pull line 64 of the pulling device 60 is pulled downward to actuate the shank 63 so as to generate a lever movement by using the spherical member 62 as a fulcrum, hence the first pull line 61 is pulled upward to actuate the pushing member 40 to move upward. Thereafter, the pushing member 40 matches with the first resilient element 30 to disengage the ratchet 221 of the post portion 22 from the ratchet seat 104 so that the ratchet 221 rotates obliquely by means of the teeth 222 and the first ratchet blocks 107, such that after the pulling force is released, the pushing member 40 and the pulling device 60 return back to an original position by using the second resilient element 50, and the rotary disk 20 finishes an engaging and positioning process by ways of the first resilient element 30, thereby lifting the water splash level.

Figure 16:
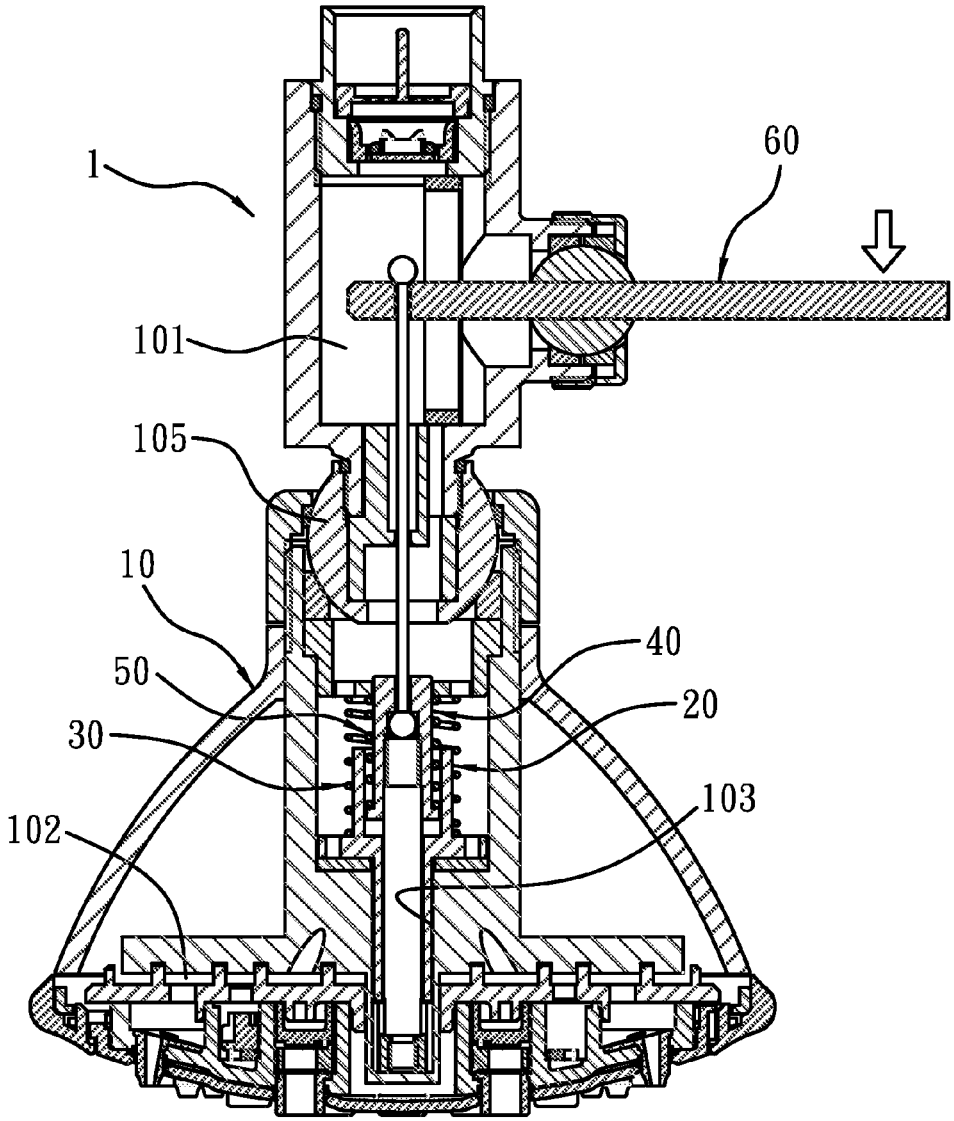
FIG. 16 is a perspective view showing the assembly of the operation of a shower head according to a second embodiment of the present invention.
Figure 17:
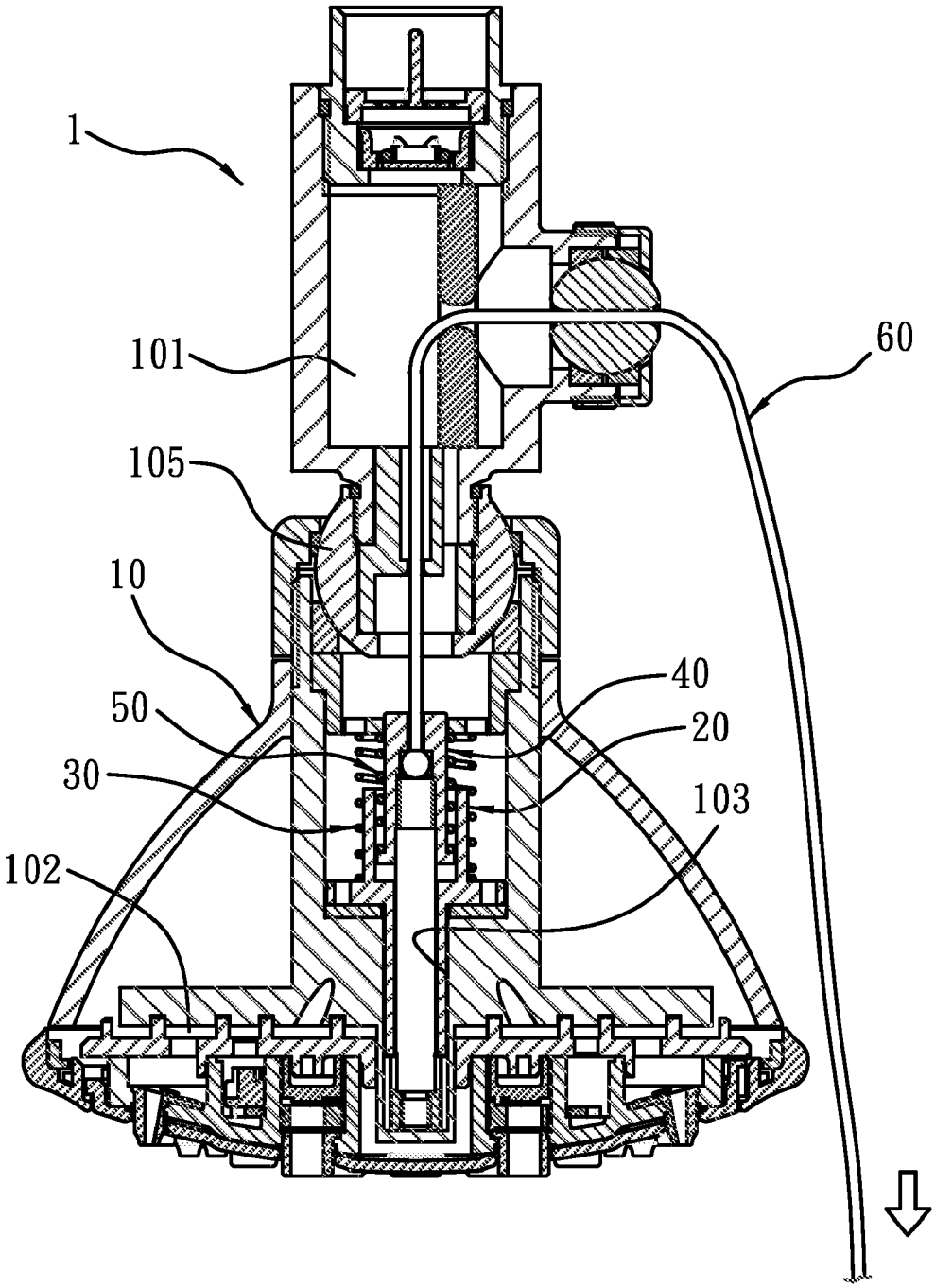
FIG. 17 is a perspective view showing the assembly of the operation of a shower head according to a third embodiment of the present invention.

Referring to FIG. 16, a difference of a shower head 1 according to a second embodiment of the present invention from that of the first embodiment contains:

a shank 63 to be moved by a user so that a spherical member 62 is used as a rotating fulcrum to generate a lever movement so that a first pull line 61 is actuated to force an axial pulling force on a pushing member 40.

With reference to FIG. 11, a difference of a shower head 1 according to a third embodiment of the present invention from that of the first embodiment contains:

a pulling device 60 including a first pull string 66, the first pull string 66 includes an inner end connecting with a top end of a pushing member 40 and an outer end extending out of a peripheral wall of a body 10 and falling downward in a certain length so that the first pull string 66 forms an inner and an outer portions of the pulling device 60. To move the first pull string 66 smoothly, a guiding structure is fixed in the tube member 10*a* to achieve a supporting and guiding effect.

The pulling devices 60 of the first, the second, and the third embodiments of the present invention all include an external portion extending from the body 10 to be forced and an internal portion located at the body 10 to be pulled, the internal portion at least contains a pull line member with a suitable length to insert through the inflow passage 101 of the body 10, wherein the pull line member is embodied as the first pull lines 61 of the first and the second embodiments and a partial first pull string 66 of the third embodiment.

Thereby, the pulling force is provided on the pushing member 40 in the axial direction without generating a dead angle during operation, thus operating the shower head effortlessly and smoothly. Furthermore, the second pull line 64 falling vertically is applied to be operated easily by the old and children.

The first and the second pull lines 61, 64 are served to provide the pulling force so that when the head assembly 10*b* rotates on the tube member 10*a*, various spray angles of the water splash can be adjusted without stopping lifting the water splash level.

While we have shown and described various embodiments in accordance with the present invention, it is clear to those skilled in the art that further embodiments may be made without departing from the scope of the present invention.

What is claimed is:

1. A shower head comprising a body including an inflow passage, a plurality of distributing passages extending from the inflow passage to distribute the water so as to generate multi-level water splash, and a first groove communicating with the inflow passage; the first groove including a ratchet seat, the ratchet seat including a plurality of ratchet blocks fixed thereon, and between any two adjacent first ratchet blocks is defined a second groove;

a rotary disk installed in the inflow passage of the body and including a second disc portion, a post portion extending downward from the second disc portion, an opening passing through the second disc portion and the post portion; the second disc portion including at least one third bore to alternatively communicate with the distributing passages with rotation; the post portion including at least one annular ratchet integrally formed on a bottom end thereof to engage with the ratchet seat, such that the ratchet is acted by an axial pushing force, a peripheral driving force, and an axial restoring force in order to rotate a predetermined angle on the ratchet seat so that the third bore of the second disc portion is rotated to communicate with another distributing passage;

a first resilient element used to provide a driving force and the restoring force onto the rotary disk;

a pushing member fixed in the opening of the rotary disk and including a number of second ratchet blocks to be retained in the second grooves of the ratchet seat of the body so as to be limited to move vertically; the second ratchet blocks moves upward when the pushing member is pulled by an axial pulling force to move upward, teeth of the rotary disk are pushed by the pushing member to disengage from the first ratchet blocks, and the rotary disk is released by the pulling force to move back to an original position;

a second resilient element used to provide the restoring force onto the pushing member after releasing the pulling force;

a pulling device served to provide the pulling force on the pushing member and including an external portion extending from the body to be forced and an internal portion located at the body to be pulled, the internal portion at least containing a pull line member with a suitable length to insert through the inflow passage of the body.

2. The shower head as claimed in claim 1, wherein the pulling device includes a first pull line, a spherical member, a shank, a second pull line, and a guiding member; wherein the first pull line is formed as the pull line member of the internal portion to connect with a top end of the pushing member;

the spherical member is defined on the body and includes a first pore formed thereon;

the shank inserts through the first pore of the spherical member and includes an inner end coupling with a top end of the first pull line;

the second pull line falls vertically to couple with the shank to be forced so that the shank is actuated to generate a lever movement by using the spherical member as a fulcrum, hence the first pull line is pulled upward to actuate the pushing member to move upward;

the guiding member is fixed in the body and a third groove formed thereon to insert the shank and to limit the shank to slide in the third groove.

3. The shower head as claimed in claim 2, wherein the pushing member includes a stem, a first sleeve, and a second sleeve, wherein the first sleeve is screwed with a bottom end of the stem and includes the second ratchet blocks;

the second sleeve is fixed on a top end of the stem and includes a fifth bore to insert the first pull line, a tabs of a bottom end of the first pull line is defined between the second sleeve and the stem so that the bottom end of the first pull line is connected with the top end of the pushing member.

4. The shower head as claimed in claim 2, wherein the shank includes a second pore to insert the first pull line so that another tab of a top end of the first pull line is coupled with an inner end of the shank.

5. The shower head as claimed in claim 2, wherein the shank includes a first extension and a limiting nut screwed on an outer side of the first extension; the first extension includes an axial second fitting portion disposed on an inner side of the limiting nut; the second pull line includes a ring fitted on a top end of the shank and axially limited and a loop coupled with a bottom end thereof.

6. The shower head as claimed in claim 2, wherein the body includes a tube member to flow the water inward and a head assembly; the tube member is used to form an upper flowing portion of the inflow passage and includes a first bore to insert the first pull line and a spherical mount to limit the spherical member; the head assembly is fixed on the spherical knob and include a lower flowing portion of the inflow passage, the distributing passages, and the first groove.

7. The shower head as claimed in claim 6, wherein the tube member includes a housing, a spherical member, a holder, a cover, and two washers;

the housing includes a tunnel formed therein to define one part of the inflow passage, an inlet segment to form the shower head secured on a top end thereof, and a projection extending from an outer surface of a peripheral wall thereof, and the projection includes a through hole communicating with the tunnel and a positioning slot proximate to the through hole;

the spherical member is screwed with a bottom end of the housing so that the spherical knob is formed on a bottom end of the tube member;

the holder is defined between the spherical member and the housing;

the cover is locked on the projection of the housing;

each washer is forced by the cover to be further retained in the positioning slot of the projection.

8. The shower head as claimed in claim 6, wherein the head assembly includes a passage assembly, a screwing element, and two pads;

the passage assembly is provided to form one parts of the inflow passage and the distributing passages and includes a first circular plate, a second circular plate, and a third circular plate; the first circular plate includes a first disc portion, an upper shaft portion extending upward from a top surface of the first disc portion, a lower shaft portion extending downward from a bottom surface of the first disc portion; the upper shaft portion includes a cavity disposed on a top end thereof to form the lower flowing portion of the inflow passage, and the cavity includes the first groove fixed on a central position of a bottom surface thereof, the first groove extends toward the lower shaft portion;

the screwing element is screwed with the top end of the upper shaft portion of the first circular plate;

the pads are fixed on a top end of the cavity of the first circular plate and limited by the screwing element so that the spherical knob is limited by the pads.

9. The shower head as claimed in claim 8, wherein the head assembly further includes the stopping member limited on the top end of the cavity of the first circular plate and defined between the pads and includes a second bore secured on a central position thereof, and the second bore includes a number of second tiny orifices formed around a peripheral surface thereof;

the second disc portion includes a first fitting portion extending upward from a top end thereof;

the first resilient element is a compression spring to be fitted onto the fitting portion of the rotary disk and includes two ends to abut against the rotary disk and the stopping member;

the second resilient element is a compression spring to be fitted on the second sleeve and includes two ends to abut against the pushing member and the stopping member individually.

10. The shower head as claimed in claim 8, wherein the head assembly further includes a casing, a nozzle member, and a lid;

the casing as illustrated is fitted on a top end of the upper shaft portion of the first circular plate and is fixed by the screwing element;

the nozzle member is defined between the third circular plate and the second circular plate;

the lid is fixed on the third circular plate.

11. The shower head as claimed in claim 1, wherein the pulling device includes a first pull line, a spherical member, and a shank;

the pull line is used to form as the pull line member of the internal portion to connect with a top end of the pushing member;

the spherical member is defined on the body and includes a first pore formed thereon;

the shank is inserted through insert through the first pore of the spherical member and includes an inner end coupling with a top end of the first pull line and an outer end to be moved downward so that the spherical member is used as a rotating fulcrum to generate a lever movement so that the first pull line is actuated to force an axial pulling force on a pushing member.

12. The shower head as claimed in claim 1, wherein the pulling device includes a first pull string, the first pull string includes an inner end connecting with a top end of a pushing member and an outer end extending out of a peripheral wall of a body and falling downward in a certain length so that the first pull string forms an inner and an outer portions of the pulling device.

* * * * *